US010618303B2

(12) United States Patent
Hasegawa et al.

(10) Patent No.: US 10,618,303 B2
(45) Date of Patent: Apr. 14, 2020

(54) LIQUID EJECTION APPARATUS

(71) Applicant: CANON KABUSHIKI KAISHA, Tokyo (JP)

(72) Inventors: Kenji Hasegawa, Kawasaki (JP); Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/226,388

(22) Filed: Dec. 19, 2018

(65) Prior Publication Data

US 2019/0210375 A1 Jul. 11, 2019

(30) Foreign Application Priority Data

Jan. 10, 2018 (JP) ..... 2018-002017

(51) Int. Cl.
*B41J 2/175* (2006.01)
*B41J 2/18* (2006.01)
*B41J 2/19* (2006.01)

(52) U.S. Cl.
CPC ..... *B41J 2/17566* (2013.01); *B41J 2/175* (2013.01); *B41J 2/17563* (2013.01); *B41J 2/18* (2013.01); *B41J 2/19* (2013.01); *B41J 2002/17579* (2013.01)

(58) Field of Classification Search
CPC . B41J 2/17566; B41J 2/175; B41J 2/19; B41J 2/17563; B41J 2/18; B41J 2002/17579
See application file for complete search history.

(56) References Cited

U.S. PATENT DOCUMENTS

| | | | | |
|---|---|---|---|---|
| 5,504,505 | A | 4/1996 | Tamura et al. | 347/13 |
| 5,617,121 | A | 4/1997 | Tachihara et al. | 347/7 |
| 8,820,899 | B2 | 9/2014 | Hoisington et al. | 347/84 |
| 9,751,317 | B2 | 9/2017 | Nakamura et al. | B41J 2/17506 |
| 2014/0132659 | A1* | 5/2014 | Van Brocklin | B41J 2/175 347/17 |

FOREIGN PATENT DOCUMENTS

| | | |
|---|---|---|
| JP | H07-117233 | 5/1995 |
| JP | 2011-520671 | 7/2011 |

* cited by examiner

*Primary Examiner* — Justin Seo
(74) *Attorney, Agent, or Firm* — Venable LLP

(57) ABSTRACT

There is provided a liquid ejection apparatus configured to circulate ink between an ink tank and an ejection head, the liquid ejection apparatus being capable of suppressing degradation of an ejection performance with a simple, inexpensive, and compact configuration. For this purpose, the liquid ejection apparatus measures impedance of the ink, and supplies, based on this measurement result, an adjusting liquid to a circulating ink.

15 Claims, 5 Drawing Sheets

LIQUID EJECTION APPARATUS

BACKGROUND OF THE INVENTION

Field of the Invention

The present invention relates to a liquid ejection apparatus including an ejection head with an ejection port from which liquid is to be ejected, and particularly relates to the liquid ejection apparatus including a mechanism for circulating the liquid inside the ejection head.

Description of the Related Art

Recently, in printing by means of a liquid ejection apparatus, miniaturization of an ejection port is required as printing resolution increases. Moreover, it is known that in the vicinity of the ejection port, viscosity of liquid to eject increases due to evaporation of a volatile component contained in the liquid to eject. In the case where the liquid whose viscosity has increased is ejected from the miniaturized ejection port, problems, such as non-ejection of liquid and/or displaced landing position of liquid, may occur.

Japanese Patent Laid-Open No. 2011-520671 describes that in order to suppress a change in a composition of ink in the vicinity of the ejection port due to evaporation of a volatile component from the ejection port, ink is circulated between an ink tank and a head. A configuration for circulating ink in this manner is effective for suppressing a change in the composition of the ink in the ejection port. However, even in the configuration for circulating ink, a volatile component of ink still evaporates from the ejection port and the ink is circulated while the volatile component evaporates, so that the percentage of the volatile component of the whole circulating ink will decrease with time. As a result, the whole ink might be thickened, resulting in degradation of ejection performance.

Japanese Patent Laid-Open No. H07-117233(1995) describes that the density of ink is detected using a characteristic vibration measurement-type densimeter, and then in accordance with a difference between this detected density and a predetermined reference density, an ink replenishing liquid is added to control the ink density in an ink circulating system so as to become a reference density.

However, with the configuration of Japanese Patent Laid-Open No. H07-117233(1995), an ink density measurement system becomes complicated and expensive, and it is also difficult to miniaturize the apparatus.

SUMMARY OF THE INVENTION

Accordingly, the present invention provides a liquid ejection apparatus configured to circulate ink between an ink tank and an ejection head, the liquid ejection apparatus being capable of suppressing degradation of ejection performance with a simple, inexpensive, and compact configuration.

The liquid ejection apparatus of the present invention includes: a first storing unit configured to store liquid; an ejecting unit configured to eject liquid supplied from the first storing unit; and a circulation flow path which is a flow path of liquid circulating between the first storing unit and the ejecting unit, in which the liquid ejection apparatus further includes: a detecting unit configured to detect a percentage of a volatile component of the liquid by measuring impedance of the circulating liquid; and an adjusting unit configured to adjust a component of the circulating liquid based on a detection result of the detecting unit.

According to the present invention, it is possible to realize a liquid ejection apparatus configured to circulate ink in a path between an ink tank and a head, the liquid ejection apparatus being capable of suppressing degradation of ejection performance with a simple, inexpensive, and compact configuration.

Further features of the present invention will become apparent from the following description of exemplary embodiments with reference to the attached drawings.

DESCRIPTION OF THE EMBODIMENTS

First Embodiment

Figure 1:
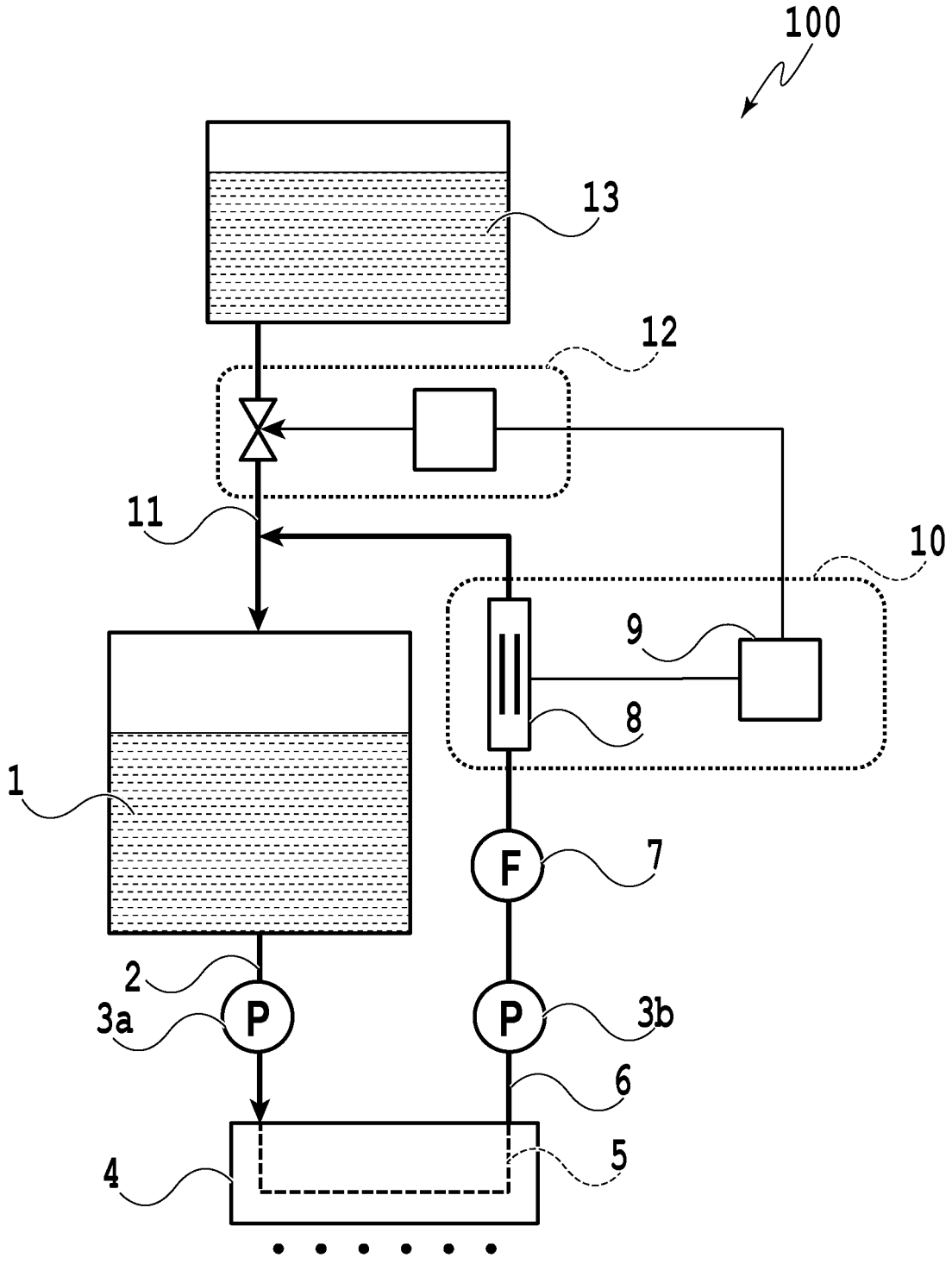
FIG. 1 is a schematic view illustrating a main portion of a liquid ejection apparatus.

Hereinafter, a first embodiment of the present invention will be explained with reference to the attached drawings. FIG. 1 is a schematic view illustrating a main portion of a liquid ejection apparatus 100 to which this embodiment can be applicable. The liquid ejection apparatus 100 includes a unit configured to circulate liquid (hereinafter, referred to also as ink) inside the apparatus. The liquid ejection apparatus 100 includes: a circulation tank 1 for temporarily storing the ink; an ejection head 4 to which the ink is supplied through a supply flow path 2 from the circulation tank 1; and an adjusting-liquid tank (adjusting-liquid storing unit) 13 configured to supply adjusting-liquid to the circulation tank 1 through an adjusting-liquid supply path 11. Furthermore, the liquid ejection apparatus 100 of this embodiment includes: an impedance sensor 10 for measuring impedance of the ink flowing out of the ejection head 4; and an adjusting-liquid control section 12 configured to control the amount of the adjusting-liquid supplied to the circulation tank 1. The impedance sensor 10 includes an impedance detection section 8 and an impedance sensor control section 9.

The ejection head 4 includes a plurality of ejection ports for ejecting the ink, and further includes an intra-head ink circulation path 5 for circulating the ink to the vicinity of an ejection port of the ejection head 4 in order to suppress a change in a composition of the ink in the vicinity of the ejection port due to evaporation of a volatile component of the ink. Flowing of the ink through the intra-head ink circulation path 5 allows also the ink, which is not to be ejected, inside the ejection port to be always replaced with the ink inside the circulation path, and allows an abrupt change in concentration of the ink, a change in viscosity, and the like to be suppressed. Into the supply flow path 2, a combined amount of both the ink to be ejected and the ink not to be ejected but circulate inside the ejection head 4 will flow.

A recovery flow path (circulation flow path) 6 is connected to the intra-head ink circulation path 5, and returns the ink, which has circulated inside the ejection head 4, to the circulation tank 1. Pumps 3*a* and 3*b* are provided in the supply flow path 2 and in the recovery flow path 6, respectively, and control the ink flow rate and the pressure on the ink at the ejection port or the like. Moreover, a filter 7 is provided on an upstream side of the impedance detection section 8 in the recovery flow path 6, and removes foreign matters and bubbles inside the circulating ink (inside the liquid). The recovery flow path 6 is connected to the adjusting-liquid supply path 11 on a downstream side of the impedance detection section 8. The ink which has circulated inside the ejection head will join the flow inside the adjusting-liquid supply path 11 through the filter 7 and impedance detection section 8, and return to the circulation tank 1.

The adjusting-liquid supply path 11 is connected to the circulation tank 1 through the adjusting-liquid control section 12 from the adjusting-liquid tank 13 which holds the adjusting-liquid for replenishing a volatile component of the ink which has evaporated. The supply amount of the adjusting-liquid from the adjusting-liquid tank 13 to the circulation tank 1 is controlled by the adjusting-liquid control section 12 based on a measured value of the impedance sensor 10.

Figure 2:
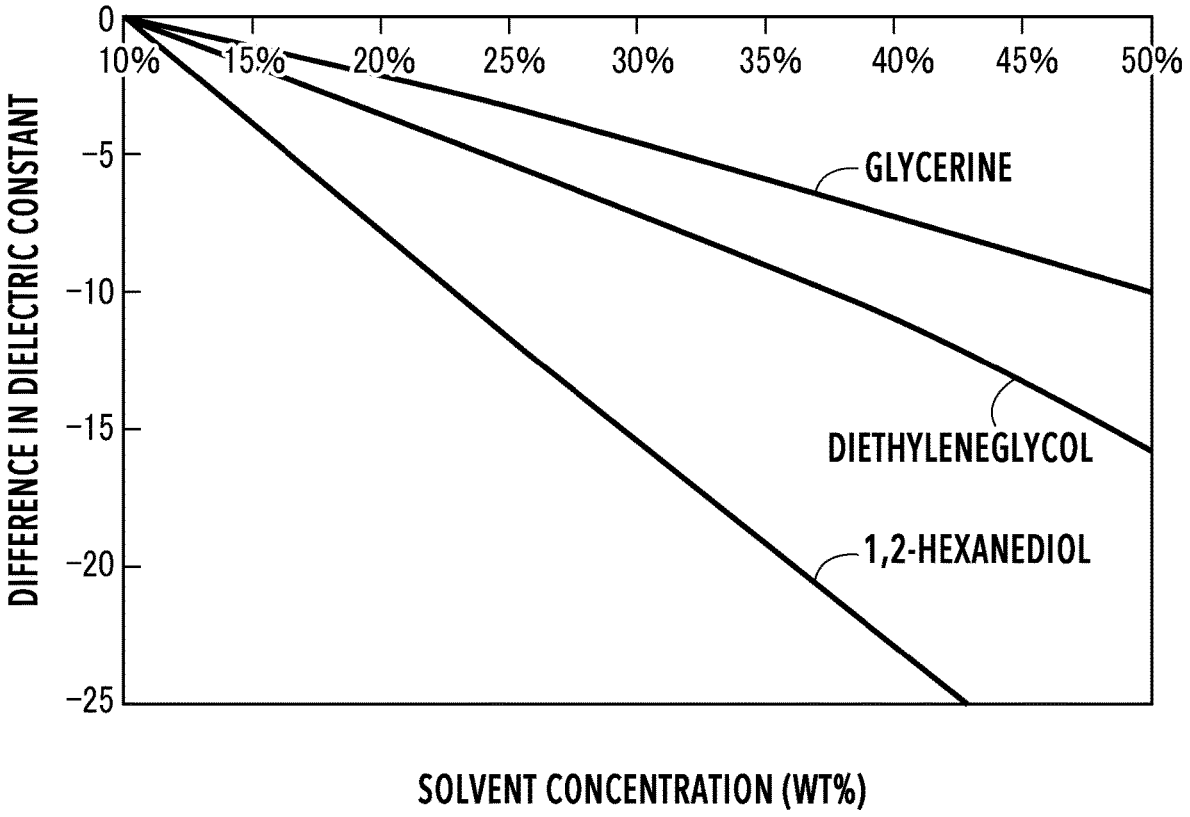
FIG. 2 is a graph illustrating a relationship between solvent concentration and relative dielectric constant of a nonvolatile solvent aqueous solution.

FIG. 2 is a graph illustrating a relationship between the solvent concentration and relative dielectric constant of a nonvolatile solvent aqueous solution representative of inkjet water-based ink used for a liquid ejection apparatus. FIG. 2 illustrates how much the relative dielectric constant of a solution decreases as compared with the initial relative dielectric constant, in a case where the solvent concentration rises assuming the initial solvent concentration is 10%. Usually, in the inkjet water-based ink, the solvent obtained by adding an approximately 10 to 50% of nonvolatile solvent to water is generally used. In such the ink, the volatile component is mainly water, and therefore once the volatile component, i.e., water evaporates and the concentration of the nonvolatile solvent rises (moisture percentage decreases), then the relative dielectric constant decreases accordingly.

Therefore, in the case of constant temperature, by obtaining the relative dielectric constant of the ink, the moisture percentage (concentration of the nonvolatile solvent) of the ink can be obtained. Then, the impedance of the ink present between two fixed electrodes corresponds to the relative dielectric constant on a one-to-one basis. Accordingly, by obtaining a relationship between the moisture percentage inside ink and the ink impedance in this measurement system in advance, the moisture percentage of ink at this time can be obtained from a measured value of the ink impedance.

Here, the examples of a method for measuring an ink concentration and/or a percentage of a volatile component may include a general optical method, the methods for measuring electric resistivity, viscosity, density, and the like. However, for example a usual black ink significantly absorbs light in a broad frequency band due to the influences of color materials, such as a dye and a pigment, so it is difficult to measure the concentration of the black ink without diluting the black ink, and it is not easy to straightforwardly incorporate an optical measurement method into a printer and the like. Moreover, a transparent window for allowing light to pass therethrough needs to be provided in a flow path, but there is a problem that once the window becomes tainted with time due to adhesion of a dye, a pigment, or the like thereto, then the measured value becomes inaccurate.

Moreover, in measuring electric resistivity, a conductive electrode needs to directly contact to the ink, and furthermore once a voltage is applied, then there are concerns on the durability of the electrode and on decomposition or the like of the ink due to electrolysis, distribution and destruction of a pigment. Therefore, the above-described methods are unsuitable for long-term stable measurement. Moreover, a method for measuring the viscosity of the ink based on the resonance/attenuation states of an oscillator has also been contemplated, but with such a straightforward scheme, it is difficult to improve the detection accuracy in viscosity on the order of several mPa·s to several tens of mPa·s used frequently for inkjet ink. Moreover, in measurement using the densimeter of Patent Literature 2, the auxiliary equipment and circuitry are complicated, large, and expensive as previously described.

Then, in the liquid ejection apparatus 100 of this embodiment, the moisture percentage of the ink is obtained by measuring the impedance of the circulating ink, thereby detecting the degree of evaporation of the ink. As compared with the method for measuring the percentage of a volatile component as described above, in the moisture percentage measurement based on impedance, two electrodes are provided in a flow path and the electrical impedance of the ink present between the two electrodes is measured, so measurement with a straightforward, low cost, and smaller configuration is possible. In particular, in the case of water which is most generally used as a volatile component of the ink, a change in dielectric constant, i.e., electrical impedance of the ink relative to a change in the percentage of a volatile component is large, so a change in the percentage of a volatile component can be accurately detected. Then, in the case where an electrode is covered with an insulating protective film, a temporal change of the electrode due to contacting with the ink is also suppressed, and the decomposition of the ink will not occur unless measured at a lower frequency.

Here, a water-based ink whose volatile component is water has been described, but also in the case of the ink whose volatile component is other than water, the relative dielectric constant generally differs between a volatile component and a non-volatile component. A difference in percentage between a volatile component and a non-volatile component would result in a difference in the relative dielectric constant, i.e., in the impedance, of the ink. Usually, ink contains a color material, such as a dye and/or a pigment, and an additive, such as a surfactant in addition to volatile and non-volatile solvent components, but because a change in the relative dielectric constant corresponding to a change in the percentage of a volatile component will occur again, measurement of the percentage of a volatile component based on the measurement of impedance is similarly possible.

Returning to FIG. 1, the configuration of the liquid ejection apparatus 100 is explained again. The impedance detection section 8 is provided on the downstream side proximate to the filter 7, the impedance detection section 8 includes two opposed electrodes, and the ink fills the space between these electrodes. In the case where gas, such as bubbles, attaches between two electrodes and the volume thereof is nonignorably large as compared with the volume of the space between the electrodes, a difference in the relative dielectric constant between the gas and the ink which is liquid is very large, so the impedance to be measured will be significantly varied (reduced). Therefore, in a portion contributing to the ink impedance measurement between the electrodes, mixing-in of bubbles needs to be avoided as much as possible. Therefore, desirably, the flow speed of the ink passing between the electrodes is fast, and in this regard, the impedance detection section 8 is desirably installed in a portion, such as the supply flow path 2 or the recovery flow path 6, where the flow speed of the ink is fast, rather than in an ink retaining portion such as the circulation tank 1. Moreover, desirably, the electrode surface is parallel to the flow of the ink as much as possible and has a shape which is unlikely to prevent the flow of the ink passing between the electrodes.

Similarly, from the viewpoint of preventing bubbles from attaching to the electrode, the impedance detection section 8 is suitably installed in the vicinity of the downstream side of the filter 7. In this embodiment, the filter 7 and impedance detection section 8 are provided in the recovery flow path 6, but these may be present in the supply flow path 2. However, also in this case, the impedance detection section 8 is desirably provided in the vicinity of the downstream side of the filter 7.

A face of the electrode of the impedance detection section 8, the face being in contact with the ink, is covered with a thin protective film having an ink resistance and an insulating property. In the cases where impedance measurement is used in detecting the remaining amount or liquid level of the ink, only a very large change in dielectric constant, such as the presence or absence of the ink, is detected, so for example an impedance detecting electrode might be installed outside the tank or the flow path. However, in the present invention, because it is necessary to capture a finer change in dielectric constant, such as a change in the percentage of a volatile component of the ink, the insulation protection film of the electrode is preferably thinner. Furthermore, desirably, the distance between two electrodes is also made shorter, in terms of improving the measurement sensitivity, to the extent that it does not prevent the flow of the ink.

Figure 3A:
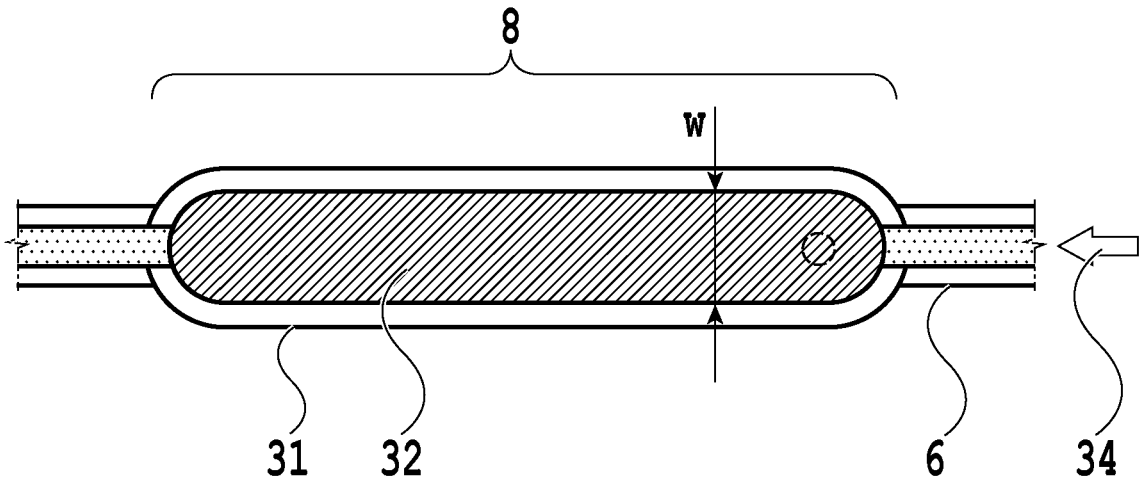
FIG. 3A illustrates an impedance detection section.
Figure 3B:
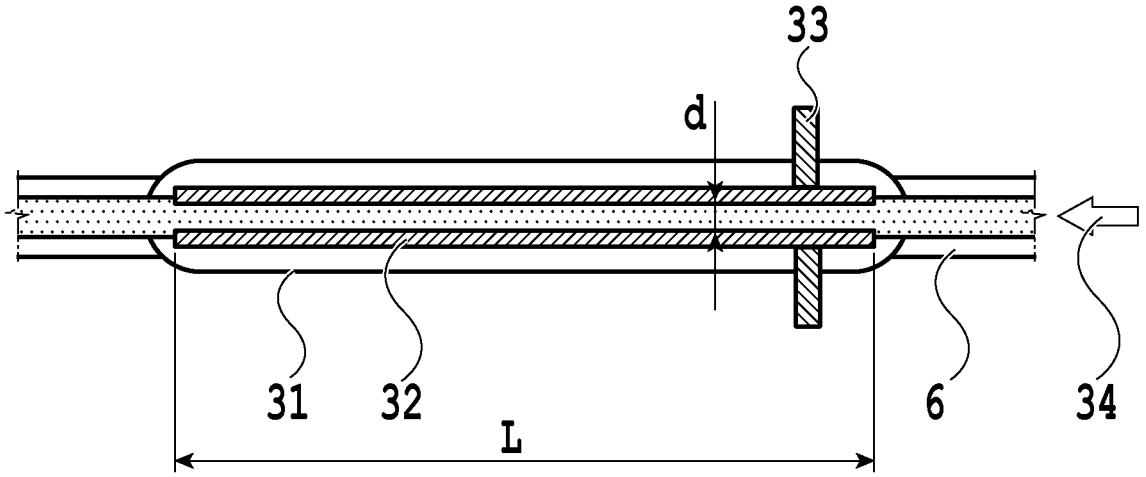
FIG. 3B illustrates the impedance detection section.

FIG. 3A and FIG. 3B illustrate the impedance detection section 8, respectively, in which FIG. 3A is a vertical cross-sectional view and FIG. 3B is a transverse cross sectional view. An electrode housing 31 formed from a resin having an ink resistance is connected to the middle of the recovery flow path 6. Two electrodes 32 made from a metal whose surface layer is covered with an ink-resistant thin insulation protection film are affixed to the inside of the electrode housing 31 so as to face each other, and an ink flow 34 passes between these two electrodes 32.

For the configuration of the impedance detection section 8, an electrostatic capacitance formed from the electrode 32 and ink needs to be an appropriate value (usually, equal to or greater than 100 pF) in order to precisely measure the impedance, and also the ink flow speed, at which the ink passes between the electrodes, needs to be fast from the viewpoint of preventing attachment of bubbles. Furthermore, the ink needs to smoothly flow as a part of the ink circulation path, and the size of the electrode and/or the distance between the electrodes need to be determined in consideration of the restrictions on the entire size of the apparatus and the like. For a suitable configuration of the impedance detection section 8, the width W of the electrode 32 is 5 mm, the length L is 40 mm, and the distance between the two electrodes is 0.5 mm, for example.

A lead connecting part 33 is formed in each electrode of the impedance detection section 8, and from here the electrode 32 is electrically connected to the impedance sensor control section 9 by wiring, thereby allowing for measurement of the impedance of the ink present between two electrodes 32. In the impedance sensor 10, the impedance detection section 8 and impedance sensor control section 9 are integrated. The impedance sensor control section 9 outputs a signal to the adjusting-liquid control section 12 in accordance with the value of the measured impedance of the ink.

Figure 4:
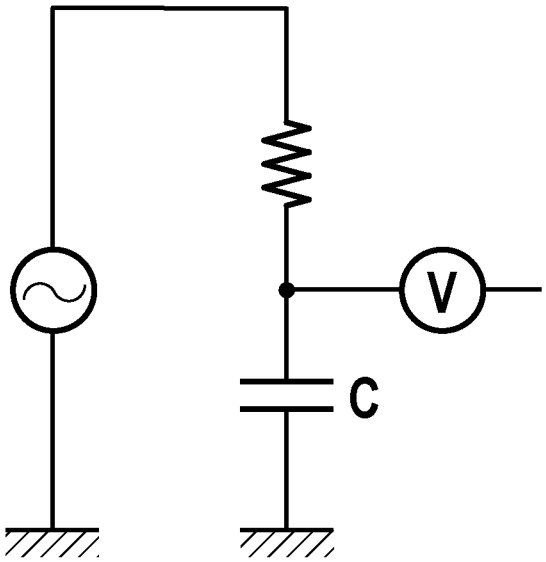
FIG. 4 illustrates a circuit of an impedance sensor.

FIG. 4 illustrates a circuit of the impedance sensor 10. A capacitor C corresponds to the impedance detection section 8, and in applying a voltage with a predetermined frequency, the impedance of the ink in the impedance detection section 8 is obtained by measuring a voltage between both ends of the impedance detection section 8.

Here, although the adjusting-liquid is a liquid containing a volatile component of the ink as the principal component, the adjusting-liquid does not necessarily need to contain only the volatile component and may be a liquid obtained, for example, by diluting the initial ink with a volatile component. Here, the adjusting-liquid is a commonly used water-based ink. A case will be explained, where the ink configured to contain water/nonvolatile solvent/color material (dye, pigment, or the like) is used. Assume that an impedance value measured using the impedance sensor 10 at a stage where water has not yet evaporated in the initial ink is Z0 and that an impedance value measured after the moisture has evaporated due to circulation is Zt, then in response to a decrease in dielectric constant due to evaporation of moisture, the impedance will increase on the contrary. Therefore, a relationship between Zt and Z0 results in $Zt>Z0$.

If the adjusting-liquid control section 12 is controlled so as to replenish an adjusting-liquid in the case of $Zt>Z0$ and not to replenish an adjusting-liquid in the case of $Zt\leq Z0$, while feeding back the measured value of the impedance sensor 10, then the moisture percentage inside the ink can be maintained within a defined range. That is, problems, such as an increase in concentration, an increase in viscosity, and the like due to evaporation of moisture in the circulating ink can be resolved. Not to mention, in order to avoid the circulating ink from unnecessary dilution, the supply amount of the adjusting-liquid by the adjusting-liquid control section 12, the feedback cycle from the impedance sensor 10 to the adjusting-liquid control section 12, and the like need to be appropriately set in accordance with the ink to be used, the used environment, and the like.

As described above, if the measured value is larger than the impedance value of the ink before volatilizing, the adjusting-liquid control section 12 controls the adjusting-liquid, based on the measured value (detection result of the detecting unit) of the impedance sensor 10, so as to supply a predetermined amount of adjusting-liquid to the circulation tank 1 from the adjusting-liquid tank 13. The adjusting-liquid control section 12 is provided in the adjusting-liquid supply path 11, and supplies the adjusting-liquid from the adjusting-liquid tank 13 to the circulation tank 1 by performing a valve control for opening/closing a valve capable of opening/closing the supply path.

In the present invention, the frequency suitable for measuring the impedance of the ink is in the range from 100 kHz to 1 GHz. At frequencies lower than this range, the contribution of the ion of a dye dissolving, a pigment dispersed, or the like in the ink to a detected value will increase, and thus the detection accuracy of a difference in impedance due to evaporation of a volatile component (mainly due to a change in an ink solvent component) will decrease. Moreover, at frequencies higher than this range, the contribution of absorption of water will undesirably increase.

The measurement of impedance for detecting the liquid level of the ink and detecting the remaining amount is conventionally performed in a liquid ejection apparatus. This utilizes a large difference in dielectric constant between ink and gas. In these schemes, presence not only of the ink but also of the gas between impedance measuring electrodes is assumed to be a premise in a certain case.

On the other hand, in the case of the present invention, it is not desirable for the gas to enter the space between the electrodes in the measurement section. This is because as compared with a change in dielectric constant (impedance) due to a change in the percentage of a volatile component of the ink, a change in dielectric constant due to a change of ink and gas is much larger, and once the gas enters the space between the measuring electrodes, then detection of a change due to evaporation of the volatile component of the ink becomes difficult. Therefore, the impedance detecting electrode in the present invention is desirably installed, as much as possible, in a place where gas (bubbles and the like) is unlikely to enter the space between the electrodes. Therefore, a desirable installation place is the place such as the ink supply flow path, the recovery flow path, or the like, where the ink flow speed is fast, rather than a tank section where the ink stays and gas is present. Furthermore, in order to suppress attachment of bubbles, the opposed electrodes in the measurement section are desirably installed substantially parallel to the flow of the ink.

Similarly, from the viewpoint of preventing bubbles from attaching to the measurement section, the vicinity on the downstream of the filter 7 present in the ink circulation path is a place suitable for installing the impedance sensor of the present invention.

Furthermore, for measuring the impedance of ink, the following sequence is suitably used: for example measurement at an identical frequency is repeated a plurality of times with a constant interval (multiple measurements), then the minimum value among the results of multiple measurements is recognized as the measured impedance value of the ink. This is because, in the case where bubbles might be caught up in the circulation path and then the bubbles might attach to and release from the electrode of the impedance detection section 8, the minimum value of the impedance may be considered as a value in the case where the influence of bubbles is minimized.

In this manner, the impedance of the ink is measured, and based on this measurement result, an adjusting-liquid is supplied to the circulating ink. Thus, a liquid ejection apparatus configured to circulate ink between an ink tank and the ejection head, the liquid ejection apparatus being capable of suppressing degradation of an ejection performance with a simple, inexpensive, and compact configuration, can be realized.

Second Embodiment

Hereinafter, a second embodiment of the present invention will be explained with reference to the accompanying drawings. Note that, because the basic configuration of this embodiment is the same as the configurations of the first embodiment, hereinafter only a characteristic configuration will be explained.

Figure 5:
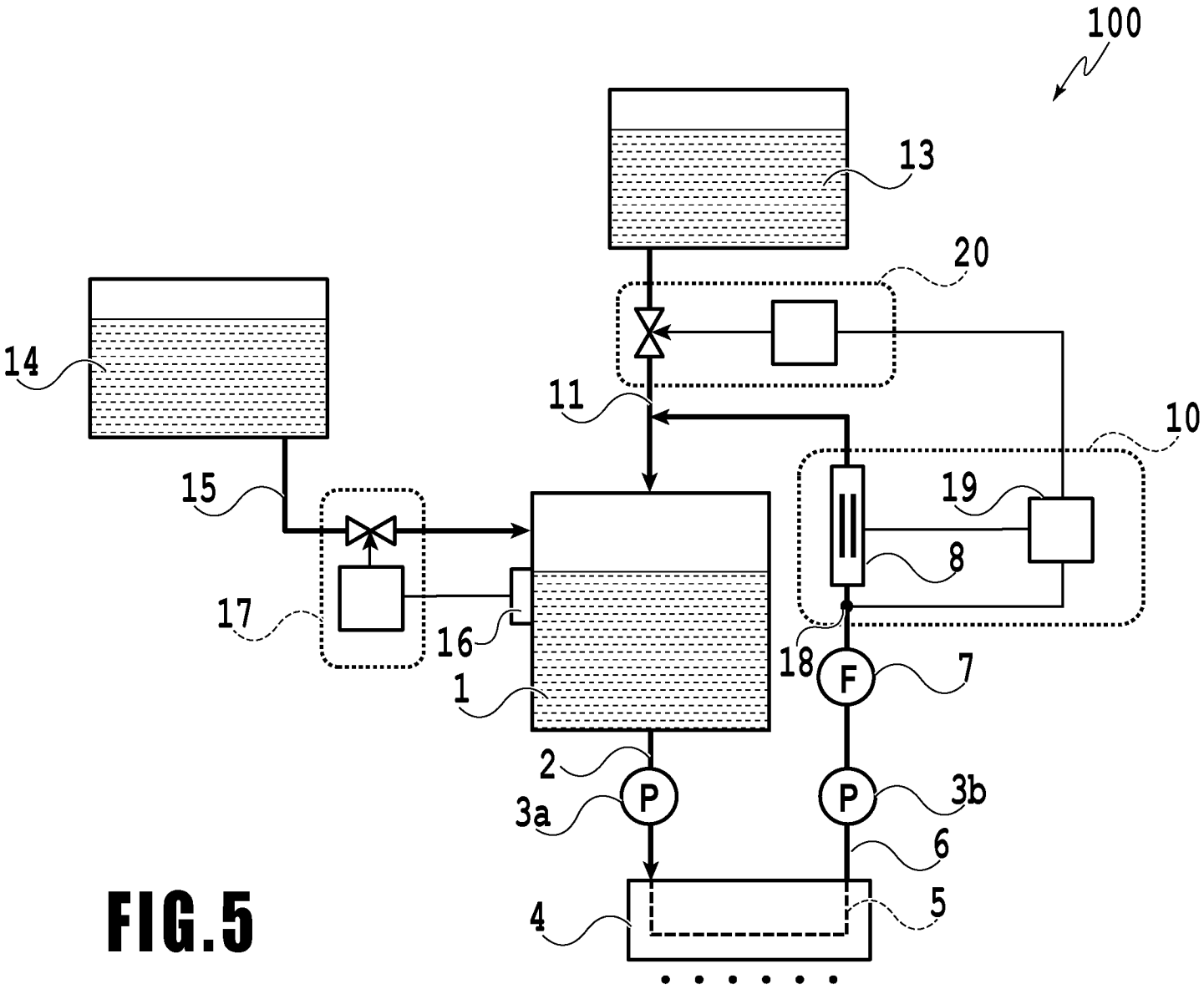
FIG. 5 is a schematic view illustrating the main portion of the liquid ejection apparatus.

FIG. 5 is a schematic view illustrating the main portion of the liquid ejection apparatus 100 in this embodiment. The liquid ejection apparatus 100 of this embodiment includes: in addition to the configuration of the liquid ejection apparatus 100 of the first embodiment, an impedance and temperature sensor 20; and a main tank 14 and an ink refilling route 15 for refilling ink to the circulation tank 1. The impedance and temperature sensor 20 includes: the impedance detection section 8; a temperature detection section 18 configured to detect the temperature of the ink (capable of detecting temperature), and an impedance and temperature sensor control section 19 configured to control both the impedance sensor and the temperature sensor. The impedance and temperature sensor 20 measures the impedance of the ink and additionally measures the temperature of the ink at that time.

Because the dielectric constant of the ink varies with temperature, the measured value of the impedance of ink also varies with temperature. The measurement of the temperature of ink during impedance measurement allows a temperature correction to be added to the measured value, and allows for more accurate control.

For example, a temperature T dependence Z0T of a measured impedance value Z0 of the initial ink is measured in advance. In the case where the actual measured impedance value inside the circulation path is Zt and the temperature of the ink at that time is T1, the control may be performed as follow: the value is compared with an impedance Z0T1 of the initial ink at the same temperature T1 so as to replenish the adjusting-liquid in the case of $Zt>Z0T1$ and not to replenish the adjusting-liquid in the case of $Zt\leq Z0T1$. Also in the case where the ink temperature varies due to the ambient temperature and the like, the percentage of a volatile component of the ink can be more precisely controlled, and the occurrence of a defect of an image due to an increase or the like in the concentration or viscosity of the ink can be suppressed.

Moreover, the main tank 14 is capable of supplying the ink to the circulation tank 1. With regard to the ink supplied to the circulation tank 1 from the main tank 14, a refill amount is controlled by an ink refill control section 17 configured to control the ink refill amount based on the measured value of a liquid level sensor 16 provided in the circulation tank 1. In this manner, the usable time of the liquid ejection apparatus can be significantly extended by adding an ink refill system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-002017 filed Jan. 10, 2018, which is hereby incorporated by reference wherein in its entirety.

What is claimed is:

1. A liquid ejection apparatus comprising:

a first storing unit configured to store liquid;

an ejecting unit configured to eject liquid supplied from the first storing unit; and a circulation flow path which is a flow path of liquid circulating between the first storing unit and the ejecting unit, the liquid ejection apparatus further comprising:

a detecting unit configured to detect a percentage of a volatile component of the liquid by measuring impedance of the circulating liquid; and an adjusting unit configured to adjust a component of the circulating liquid based on a detection result of the detecting unit; and wherein the detecting unit is provided in the circulation flow path on a downstream side of the ejecting unit.

2. The liquid ejection apparatus according to claim 1, wherein the detecting unit includes a measuring unit configured to measure an impedance of liquid, and an outputting unit configured to output a signal based on a measurement result of the measuring unit.

3. The liquid ejection apparatus according to claim 2, wherein the adjusting unit includes an adjusting-liquid storing unit configured to store an adjusting-liquid for adjusting a component of liquid, and a supplying unit configured to supply the adjusting-liquid to the first storing unit from the adjusting-liquid storing unit.

4. The liquid ejection apparatus according to claim 3, wherein the supplying unit includes: a supply flow path which is a flow path of liquid supplied to the first storing unit from the adjusting-liquid storing unit; a valve capable opening/closing a flow path of the supply flow path; and a valve controlling unit configured to open/close the valve.

5. The liquid ejection apparatus according to claim 4, wherein the valve controlling unit opens/closes the valve based on a signal output by the outputting unit.

6. The liquid ejection apparatus according to claim 2, further comprising a temperature detecting unit capable of detecting temperature of liquid measured by the measuring unit.

7. The liquid ejection apparatus according to claim 6, further comprising a second storing unit capable of supplying liquid to the first storing unit, the second storing unit being configured to store liquid.

8. The liquid ejection apparatus according to claim 2, wherein the measuring unit is configured to measure an impedance at a frequency in a range from 100 kHz to 1 GHz.

9. The liquid ejection apparatus according to claim 1, further comprising, on an upstream side of the detecting unit, a filter capable of capturing a foreign matter and a bubble inside the circulating liquid.

10. The liquid ejection apparatus according to claim 2, wherein the outputting unit outputs a signal, as a measured value, which is a minimum value among a plurality of measured values obtained by the measuring unit which has performed measurement a plurality of times.

11. The liquid ejection apparatus according to claim 2, wherein the measuring unit includes two electrodes, and is configured to measure an impedance of liquid flowing between the two electrodes.

12. A liquid ejection apparatus comprising:

a first storing unit configured to store liquid;

an ejecting unit configured to eject liquid supplied from the first storing unit; and a circulation flow path which is a flow path of the liquid circulating between the first storing unit and the ejecting unit, the liquid ejection apparatus further comprising:

a measuring unit configured to measure an impedance of the circulating liquid; and an adjusting unit configured to adjust a component of the circulating liquid based on a measurement result of the measuring unit; and wherein the measuring unit is provided in the circulation flow path on a downstream side of the ejecting unit.

13. The liquid ejection apparatus according to claim 12, wherein the adjusting unit includes: an adjusting-liquid storing unit configured to store an adjusting-liquid for adjusting a component of liquid; and a supplying unit configured to supply the adjusting-liquid to the first storing unit from the adjusting-liquid storing unit.

14. The liquid ejection apparatus according to claim 12, further comprising a detecting unit configured to detect a percentage of a volatile component of liquid based on a measurement result by the measuring unit.

15. The liquid ejection apparatus according to claim 14, further comprising, on the upstream side of the detecting unit, a filter capable of capture a foreign matter and a bubble inside the circulating liquid.

* * * * *